US006014918A

United States Patent [19]

Orloff

[11] Patent Number: 6,014,918

[45] Date of Patent: Jan. 18, 2000

[54] TRANSCUTANEOUS ELECTRIC NERVE STIMULATOR RAZOR SYSTEM

[75] Inventor: Glennis J. Orloff, Woodbridge, Conn.

[73] Assignee: Warner & Lambert Company, Morris Plains, N.J.

[21] Appl. No.: 09/181,422

[22] Filed: Oct. 28, 1998

[51] Int. Cl.[7] ..... B26B 19/38

[52] U.S. Cl. ..... 83/13; 30/34.05; 606/45

[58] Field of Search ..... 30/34.05, 140, 30/32; 83/13; 606/45, 49

[56] References Cited

U.S. PATENT DOCUMENTS

| | | | |
|---|---|---|---|
| 3,610,080 | 10/1971 | Kuris | 83/13 |
| 4,918,818 | 4/1990 | Hsieh | 30/34.05 |
| 4,949,721 | 8/1990 | Toriu et al. | 128/421 |
| 5,038,797 | 8/1991 | Batters | 128/798 |
| 5,048,523 | 9/1991 | Yamasawa et al. | 128/421 |
| 5,165,170 | 11/1992 | Sagol et al. | 30/34.05 |
| 5,217,009 | 6/1993 | Kronberg | 128/419 F |
| 5,653,025 | 8/1997 | Cheng et al. | 30/140 X |
| 5,766,236 | 6/1998 | Detty et al. | 607/149 |

FOREIGN PATENT DOCUMENTS

| | | | |
|---|---|---|---|
| 2703290 | 10/1994 | France | 30/34.05 |

*Primary Examiner*—Rinaldi I. Rada
*Assistant Examiner*—Charles Goodman
*Attorney, Agent, or Firm*—Charles W. Almer

[57] ABSTRACT

A transcutaneous electric nerve stimulator wet shave razor system. The razor cartridge of this system contains at least two electrodes, preferably the blades, and the system contains sufficient electronics to generate an electrical signal. The electrodes are adjacent to electrical contacts within the razor cartridge and the contacts are connected, via wires, to a signal generation circuit which is connected to one or more batteries. The battery produces a voltage which is to generate a waveform by the signal processing unit. The signal is transmitted to the electrodes and produces an electrical stimulation which affects the skin when it comes into contact with the electrodes. The resulting effect on the skin is a reduction in any discomfort or pain as well as an enhanced tactile experience during the shaving process.

44 Claims, 3 Drawing Sheets

TRANSCUTANEOUS ELECTRIC NERVE STIMULATOR RAZOR SYSTEM

BACKGROUND OF THE INVENTION

1. Field of the Invention

This invention relates to a transcutaneous electric nerve stimulator razor system to enhance the quality of a shave.

2. Description of Related Art

Shaving with a wet shave razor, especially by individuals with sensitive skin, is occasionally an uncomfortable or even a painful process. Much of this discomfort or pain is associated with the stimulation of the large number of nerves within the skin which are adjacent to the hair follicles. Efforts to reduce and even eliminate this discomfort have been ongoing for many years, with varied degrees of success.

The reduction of pain through the use of transcutaneous electric nerve stimulation ("TENS") has been known throughout history. Current technology implements electrical circuits generating an electric voltage or current versus time waveform to provide relief to people with chronic pain. Although the exact mechanism by which TENS works is not completely understood, theories propose that TENS works by an electrical stimulation of the nerve which consequently reduces pain by blocking the signal from the nerve so that the pain is not perceived, by causing the release of endorphins that reduce pain, or by local biochemical interactions. The current technology implements electrodes that are placed on the skin and electrical impulses are transmitted through the skin to the underlying nerve fibers. The resulting sensation is adjusted to the patient's threshold of tolerance, however it is believed that stimulation which is at or below the patient's perception is also beneficial in managing pain.

Electric nerve stimulation not only can reduce or eliminate pain but can also generate new sensations because of the nerve structure within the skin. The nerves within the skin are very sensitive to mechanical, thermal and electrocutaneous stimulation. Stimulation of these senses in various combinations provides the tactile feelings one experiences. The nervous system utilizes a bioelectrical method to conduct nerve impulses. By using electrical stimulation, it is possible to mimic the sensations produced by normal stimuli such as feelings of warmth or vibration. Consequently, not only can transcutaneous nerve stimulation reduce or eliminate pain but it can also be used to change the feel of shaving.

It would be advantageous to provide a razor system which included a TENS system which would either reduce or even completely eliminate any pain or discomfort resulting from shaving while providing a new tactile experience. The TENS system would consequently improve the overall quality of the shave.

SUMMARY OF THE INVENTION

The present invention is directed to a transcutaneous electric nerve stimulator wet shave razor system. The razor cartridge of this system contains at least two electrodes, preferably the blades, and the system contains sufficient electronics to generate an electrical waveform. The electrodes are adjacent to electrical contacts within the razor cartridge and the contacts are connected, via wires, to a signal generation circuit which is connected to one or more batteries. The battery produces a voltage and current which is converted to a waveform by the signal processing unit. The waveform is transmitted to the electrodes and produces an electrical stimulation that transfers energy from the TENS device to the skin and tissue. The resulting effect on the skin is a reduction in any discomfort or pain caused by the shaving process as well as providing a new tactile experience.

DETAILED DESCRIPTION OF THE PREFERRED EMBODIMENTS

Reference will now be made to the presently preferred embodiments of the invention. For the purposes of this application, wet shave razors are defined to be razors which are customarily utilized in conjunction with soap or shaving cream and hot water. The definition of wet shave razors includes both disposable razors, in which the user discards the entire unit after a certain number of uses, and permanent systems, with which the user discards and replaces the razor cartridge after a certain number of uses. In both instances, the razor head, or cartridge, is the portion which surrounds and contains the blade or blades. The combination of the razor head and the handle, either permanent or disposable, is defined as the razor system.

The present invention provides for a transcutaneous electric nerve stimulator ("TENS") wet shave razor system having one or more electrodes that produce an electrical impulse which is transmitted through the skin to the underlying nerve fibers. The electrical stimulation of the nerve reduces or eliminates any discomfort or pain caused by the shaving process as well as enhances the tactile experience. While the exact mechanism by which TENS reduces and eliminates pain is unknown, it is speculated that TENS possibly blocks the signal from the nerve so that the pain is not perceived, causes the release of endorphins which reduce pain, or causes local biochemical interactions which reduce pain. Electrical stimulation can also be used to mimic the sensations produced by normal stimuli such as feelings of warmth or vibration consequently changing the feel of shaving.

Figure 1:
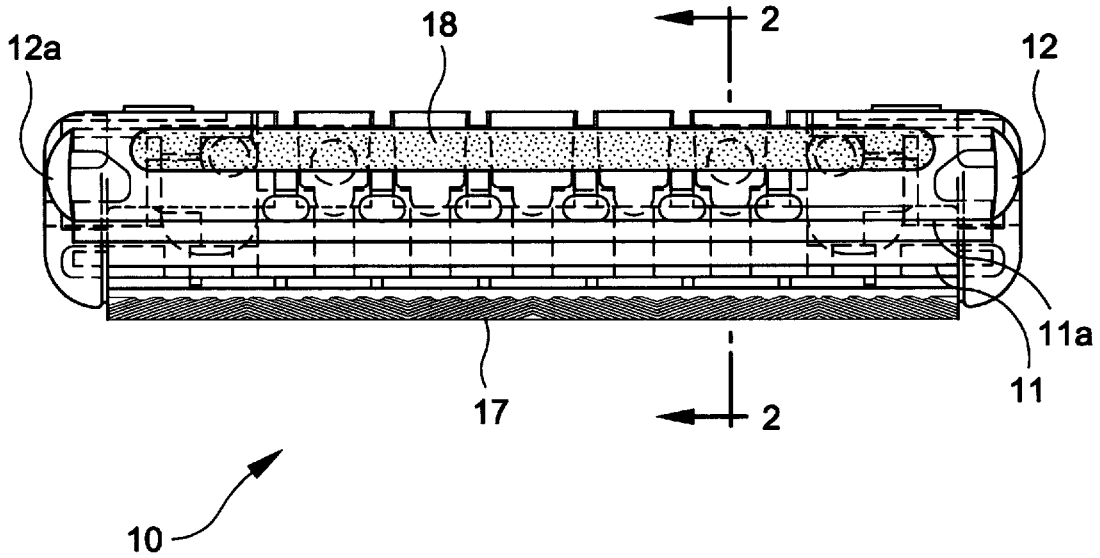
FIG. 1 is a top view of a razor cartridge for use in a transcutaneous electric nerve stimulator razor system.
Figure 2:
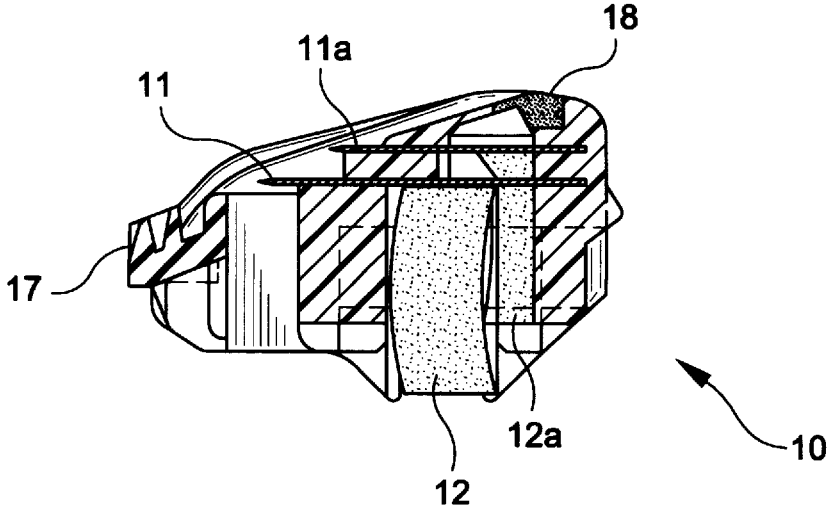
FIG. 2 is a cut-away side view of a razor cartridge for use in a transcutaneous electric nerve stimulator razor system.

As shown in FIGS. 1 and 2, the razor cartridge 10 for use with the TENS razor system comprises a standard razor cartridge having two razor blades 11, 11*a*. While a non-disposable razor cartridge having two blades is illustrated, it is within the scope of the invention to have a TENS razor system which is disposable and/or which has one, three or more blades. One or more electrodes, comprising an electrically conductive material, are in a skin-engaging portion of the cartridge. Preferably the electrodes are the blades 11, 11*a*. However, the electrodes may be any skin-engaging portion of the cartridge which is electrically conductive. For example, guard bar 17 or cap/shaving aid member 18 may also act as electrodes when electrically active material is implemented. Examples of various electrically conductive materials that may be employed as electrodes include stainless steel, copper or other metals.

The electrodes, preferably blades 11, 11*a*, are in direct contact with electrical contacts 12, 12*a* that are preferably located at each end of the cartridge. The electrical contacts comprise electrically conductive strips that extend from the electrodes to a point adjacent to the lower edge of the cartridge. The electrical contacts preferably consist of a conductive plastic, but they may also consist of any metal such as copper and stainless steel, or an electrically conductive ink or epoxy.

Figure 3:
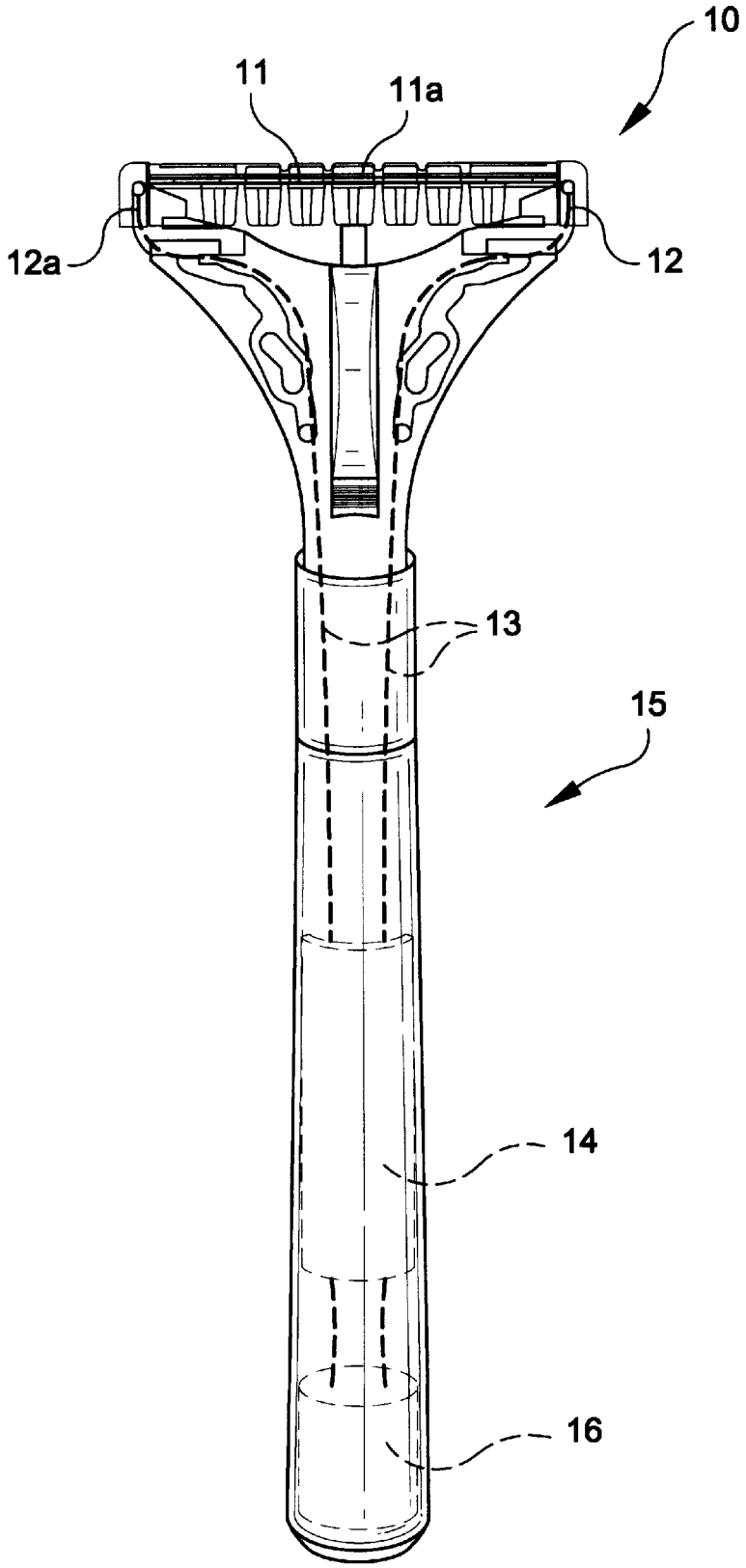
FIG. 3 is a cut-away top view of a razor cartridge and handle for use in a transcutaneous electric nerve stimulator razor system.

FIG. 3 illustrates the cartridge 10 in place on the razor handle 15 to form the entire razor system. When the cartridge is in position on the handle, electrical contacts 12, 12*a* contact wires 13 which extend from the upper end of the handle through the handle to a signal generation circuit 14 located within the handle. The signal generation circuit produces electrical pulses with an amplitude, frequency, and pulse width set to provide an optimal shave experience. The pulses may be modulated and their shape can be varied. Pulses consist of one or more pulse sequences with one or more pulses. Also attached via wire to the signal generation circuit is a power source, preferably battery 16. The battery must be sufficiently powerful to produce a voltage in the range of about 1 volt to about 50 volts in order to activate the signal generation circuit. Preferred examples of suitable batteries include secondary, rechargeable, batteries like NiCd, metal hydride, or Lithium or primary, non-rechargeable, such as alkaline. Alternative power sources, such as standard alternating current and solar energy may also be utilized. In the event that AC is utilized, the razor handle would simply be adapted with an electrical cord and a wall plug unit, while in the event that solar energy is utilized a portion of the razor system would be adapted with solar panels.

The signal generation circuit processes the voltage from the battery and produces an electrical impulse which is carried through the handle 16 via the wires 13 to the electrical contacts 12, 1 2*a* and then to the skin-engaging electrodes of the razor cartridge, preferably blades 11, 11*a*. Ultimately, the impulse is transmitted through the skin to the nerve fibers in the area being shaved. In an alternative embodiment not illustrated, the wires extend sufficiently beyond the end of the handle so that the wires come into direct contact with the electrodes without the need for any additional electrical contacts. Alternatively, the electrodes extend beyond the cartridge so that the electrodes come into contact with the wires at a point outside of the body of the cartridge. In the preferred embodiment the electrical impulse will be sufficient to enhance the shaving sensation of the user. However, the impulse may be varied depending upon the sensation most desired by the user and the area of the body being shaved. A preferred impulse amplitude for the male user when shaving the face would be in the range of from about 1 volt to about 6 volts, while the overall potential impulse amplitude range which would be desired for shaving comfort of the face is from about 0.2 volt to about 25 volts. Female users who shave other areas of the body prefer impulse amplitudes in the range of from about 5 volts to about 30 volts while the overall impulse amplitude range for shaving comfort in those other areas is from about 0.2 volt to 50 volts. The frequency range most desired for shaving comfort and the appropriate sensation is from about 1 Hz to about 10,000 Hz. A preferred frequency range for male users shaving the face would be from about 50 Hz to about 500 Hz. For optimal performance for female users in shaving other areas of the body, a frequency range of from about 1 Hz to about 250 Hz is preferred. Depending upon the desired shaving sensation, the duty cycle may range from about 0.01% to about 50%. A preferred duty cycle for male users shaving the face would be in the range of from about 25% to about 50%, while a preferred duty cycle for female users shaving other body areas would be in the range of from about 0.05% to about 25%. Further, the waveform type may be of virtually any known type. In addition to the application of the claimed invention to male and female sub-segments of the shaving population, additional variations of the claimed invention could be tailored to appeal to other sub-segments of shavers such as light versus heavy beards, young versus old users, sensitive or non-sensitive skin, ethnic sub-groups and more.

Figure 4:
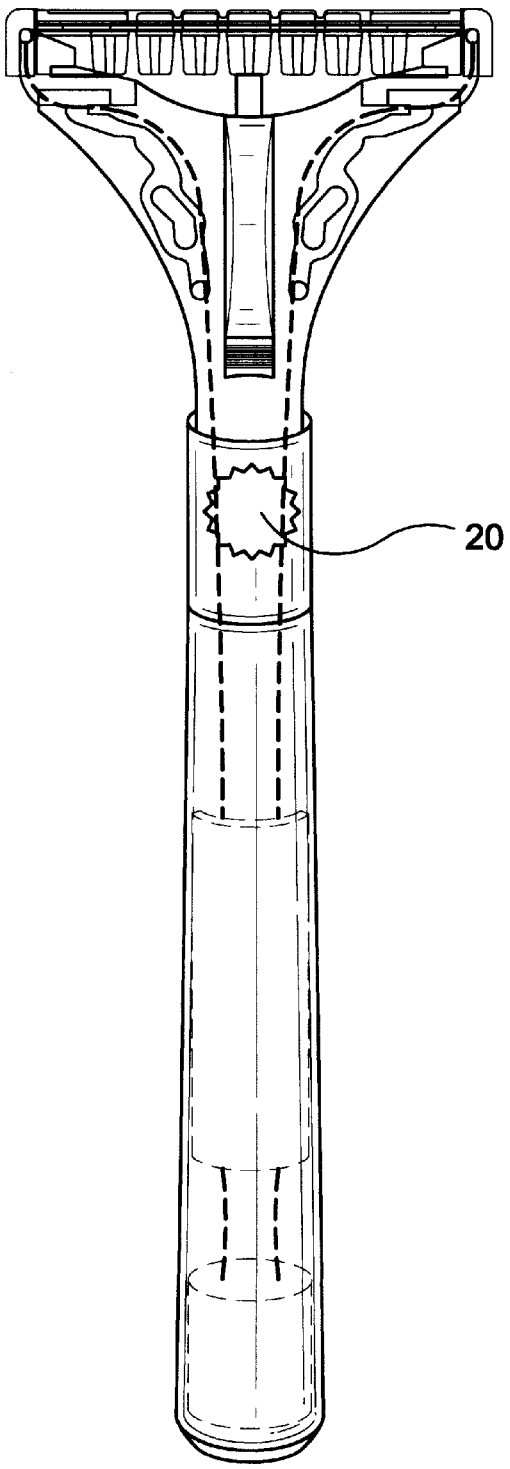
FIG. 4 is a cut-away top view of a razor cartridge and handle for use in an alternative embodiment of a transcutaneous electric nerve stimulator razor system.

FIG. 4 illustrates an alternative embodiment of the present invention. In this embodiment, indicator 20 is connected to the wires. Indicator 20 is activated when a current is flowing through the wires to notify the user that the TENS system is activated. For example indicator 20 may comprise a light to produce a visual sensation or a noise generator to produce an audible sensation to the user so that he or she will know that the TENS system is working.

While there have been shown and described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A transcutaneous electric nerve stimulator razor system comprising a razor head and a handle, wherein the razor head contains one or more electrodes which are in a skin-engaging position and the handle contains a signal generation circuit, a power source and a means of transmitting an electrical impulse from the power source to the signal generation circuit and from the signal generation circuit to the razor head.

2. A razor system according to claim 1, wherein the one or more electrodes comprise one or more of at least one razor blade, razor guard bar, cap and shaving aid segments of the razor head.

3. A razor system according to claim 2, wherein the one or more electrodes comprise the at least one razor blade.

4. A razor system according to claim 3, wherein the one or more electrodes comprise two or more razor blades.

5. A razor system according to claim 2, wherein the means for transmitting the electrical impulse are wires.

6. A razor system according to claim 5, wherein the razor head further comprises at least two electrical contacts which are in direct contact with the one or more electrodes.

7. A razor system according to claim 6, wherein the at least two electrical contacts comprise an electrically conductive strip.

8. A razor system according to claim 7, wherein the electrically conductive strip comprises one or more of the group consisting of conductive plastics, copper, stainless steel, electrically conductive ink, electrically conductive epoxy or mixtures thereof.

9. A razor system according to claim 8, wherein the power source comprises one or more batteries.

10. A razor system according to claim 9, wherein the one or more batteries produce an electrical voltage in a range of from about 1 to about 50 volts.

11. A razor system according to claim 9, wherein the signal generation circuit produces an electrical impulse amplitude in a range of from about 0.2 to about 50 volts.

12. A razor system according to claim 11, wherein the signal generation circuit produces the electrical impulse amplitude in a range of from about 1 to about 6 volts.

13. A razor system according to claim 11, wherein the signal generation circuit produces the electrical impulse amplitude in a range of from about 5 to about 30 volts.

14. A razor system according to claim 9, wherein the signal generation circuit produces the frequency range in a range of from about 1 Hz to about 10000 Hz.

15. A razor system according to claim 14, wherein the signal generation circuit produces the frequency range in a range of from about 50 Hz to about 500 Hz.

16. A razor system according to claim 14, wherein the signal generation circuit produces the frequency range in a range of from about 1 Hz to about 250 Hz.

17. A razor system according to claim 9, wherein the signal generation circuit provides a duty cycle ranging from about 0.01% to about 50%.

18. A razor system according to claim 17, wherein the signal generation circuit provides the duty cycle ranging from about 25% to about 50%.

19. A razor system according to claim 17, wherein the signal generation circuit provides the duty cycle ranging from about 0.05% to about 25%.

20. A razor system according to claim 1, wherein the razor head and the handle are integral with each other.

21. A razor system according to claim 1, further comprising an indicator to provide an indication to a user that the transcutaneous electric nerve stimulator is operating.

22. A razor transcutaneous electric nerve stimulator razor system comprising a razor cartridge and a handle, the handle containing a signal generation circuit, a power source and a means for transmitting electric impulse from the power source to the signal generation circuit and from the signal generation circuit to the razor cartridge, wherein the cartridge comprises one or more electrodes and one or more electrical contacts, the one or more electrodes being in direct contact with the one or more electrical contacts.

23. A razor system according to claim 22, wherein the one or more electrodes comprise one or more of at least one razor blade, razor guard bar, cap and shaving aid segments of the razor cartridge.

24. A razor system according to claim 23, wherein the one or more electrodes comprise the at least one razor blade.

25. A razor system according to claim 24, wherein the one or more electrodes comprise two or more razor blades.

26. A razor system according to claim 22, wherein the razor cartridge further comprises at least two electrical contacts which are in direct contact with the one or more electrodes.

27. A razor system according to claim 26, wherein the at least two electrical contacts comprise an electrically conductive strip.

28. A razor system according to claim 27, wherein the electrically conductive strip comprises one or more of the group consisting of conductive plastics, copper, stainless steel, electrically conductive ink, electrically conductive epoxy or mixtures thereof.

29. A transcutaneous electric nerve stimulator razor system comprising a razor handle and a razor cartridge, the razor cartridge having one or more electrodes and one or more electrical contacts, wherein the razor handle comprises an upper end for attachment to the razor cartridge, a signal generation circuit, a power source and a means for transmitting electric impulse from the power source to the signal generation circuit and from the signal generation circuit to a position adjacent to the upper end of the razor handle.

30. A razor system according to claim 29, wherein the means for transmitting the electrical impulse are wires.

31. A razor system according to claim 29, wherein the power source comprises one or more batteries.

32. A razor system according to claim 31, wherein the one or more batteries produce an electrical voltage in a range of from about 1 to about 50 volts.

33. A razor system according to claim 29, wherein the signal generation circuit produces an electrical impulse amplitude in a range of from about 0.2 to about 50 volts.

34. A razor system according to claim 33, wherein the signal generation circuit produces the electrical impulse amplitude in a range of from about 1 to about 6 volts.

35. A razor system according to claim 33, wherein the signal generation circuit produces the electrical impulse amplitude in a range of from about 5 to about 30 volts.

36. A razor system according to claim 29, wherein the signal generation circuit produces the frequency range in a range of from about 1 Hz to about 10000 Hz.

37. A razor system according to claim 36, wherein the signal generation circuit produces a frequency range in a range of from about 50 Hz to about 500 Hz.

38. A razor system according to claim 36, wherein the signal generation circuit produces the frequency range in a range of from about 1 Hz to about 250 Hz.

39. A razor system according to claim 29, wherein the signal generation circuit provides a duty cycle ranging from about 0.01% to about 50%.

40. A razor system according to claim 39, wherein the signal generation circuit provides the duty cycle ranging from about 25% to about 50%.

41. A razor system according to claim 39, wherein the signal generation circuit provides the duty cycle ranging from about 0.05% to about 25%.

42. A razor system according to claim 29, further comprising an indicator to provide an indication to a user that the transcutaneous electric nerve stimulator is operating.

43. A method of shaving that reduces pain and discomfort during shaving comprising the steps of: providing a razor system comprising a razor head and a handle, wherein the razor head contains one or more electrodes which are in a skin-engaging position and the handle contains a signal generation circuit, a power source and a means of transmitting an electrical impulse from the power source to the signal generation circuit and from the signal generation circuit to the razor head to provide a transcutaneous electric nerve stimulation; and removing hair by movably engaging the razor head with the skin.

44. A method according to claim 43, further comprising the step of providing an electrical impulse through the electrodes to thereby provide the transcutaneous electric nerve stimulation.

* * * * *